United States Patent [19]

Cooper et al.

[11] Patent Number: 4,786,250

[45] Date of Patent: Nov. 22, 1988

[54] INSTALLATION FOR EVACUATING EMANATIONS IN THE TAPHOLE REGION OF SHAFT FURNACES

[75] Inventors: Arthur W. Cooper, Ancaster; Carlo M. P. Spedener, Burlington, both of Canada

[73] Assignee: Paul Wurth, S.A., Luxembourg, Luxembourg

[21] Appl. No.: 115,696

[22] Filed: Nov. 2, 1987

[30] Foreign Application Priority Data

Nov. 6, 1986 [LU] Luxembourg ..... 86.648

[51] Int. Cl.[4] ..... F27D 1/08

[52] U.S. Cl. ..... 432/95; 432/72; 266/158; 98/115.4

[58] Field of Search ..... 432/72, 95, 3, 40, 187; 98/115.4; 266/158, 159

[56] References Cited

U.S. PATENT DOCUMENTS 4,114,864 9/1978 Jager et al. ..... 432/72
4,234,170 11/1980 Suitlas ..... 98/115.4
4,379,548 4/1983 Boshoven ..... 266/158

*Primary Examiner*—Henry C. Yuen
*Attorney, Agent, or Firm*—Fishman, Dionne & Cantor

[57] ABSTRACT

An installation for evacuating emanations in the taphole region of a shaft furnace (e.g. blast furnace) of the type having a blast connection arrangement around the furnace bosh, together with a blast connection stage or platform for the inspection and servicing of the blast connections, and in which the molten metal is periodically tapped with the aid of tapping means and run off through a main tapping runner or spout includes the feature wherein a portion of the blast connection platform is adapted to be tilted away in the upward direction. This tiltable platform portion, when in its untilted position forms, together with vertical side walls which extend from the two side ends of the platform portion, a flue-like exhaust duct for the emanations produced directly in the taphole region. The present invention further comprises a movable exhaust hood connected to a stationary suction line and a mobile tapping spout hood having at the top an exhaust opening situated under the exhaust hood. The flue-like exhaust duct leads into the open end of the tapping spout hood (e.g., its end near the furnace) and both the emanations produced under the tapping spout hood and those passing out of the exhaust duct are drawn off through the top exhaust opening, the exhaust hood and the suction line connected thereto. Finally, the present invention also includes a transfer device for moving the mobile tapping spout hood and thus removing it from the tapping spout region in order to free space for the movement of the tapping appliances (e.g. taphole drilling machine and taphole gun).

19 Claims, 10 Drawing Sheets

INSTALLATION FOR EVACUATING EMANATIONS IN THE TAPHOLE REGION OF SHAFT FURNACES

BACKGROUND OF THE INVENTION

This invention relates generally to an installation for evacuating emanations in the taphole region of shaft furnaces, particularly blast furnaces. More particularly, this invention relates to an installation for evacuating emanations in the taphole region of a shaft furnace of the type which has a blast connection arrangement around the furnace bosh, together with a blast connection stage or platform for the inspection and servicing of the blast connections; and in which the molten pig iron is periodically tapped with the aid of tapping means and run off through a main tapping runner or spout.

In accordance with the present invention, the expressions "emanations" is used broadly as a collective term for the accumulation of smoke, gases, vapors and dust particles occurring mainly upon the discharge of pig iron in the region of the taphole and tapping spout of a blast furnace. These emanations are not only dangerous to the health of operators, but generally pollute the environment. In addition, the emanations soil and corrode the operating plant, both within and beyond the region of the taphole and tapping spout.

In order to keep the deleterious effects of such emanations within more or less tolerable limits and in accordance with the prior art, blast furnace installations have been provided (particularly in the case of larger installations where problems of space are not so important) with stationary exhaust hoods or scoops and the like, as well as exhaust ducts, which laterally draw off the emanations accumulating above the tapping runner.

The above-discussed measures employed in the prior art have a number of disadvantages and shortcomings. For example, the stationary exhaust scoop cannot be taken as far down towards the taphole region as would be desired (in order, for example, to avoid hindering the operation of the taphole drilling machine and the taphole gun). Not only is the stationary exhaust scoop limited solely for larger furnaces because of the large space required, but in addition, its effect is very unreliable because of its relatively great distance from the critical region (e.g. where emanations originate). Moreover, if the action of the exhaust scoop is to be satisfactory to any extent, higher air throughputs must be obtained, with corresponding high power consumption leading to high costs.

The aforementioned exhaust ducts for the emanations occurring above the tapping spout itself must be laterally positioned in order not to hinder the operation of the drilling machine and taphole gun as mentioned above. This process of exhausting the emanations is consequently not effected in the direction of the natural thermal upthrust of the hot emanations, so that a relatively great suction power is required to draw off the emanations laterally; instead of vertically upwards. This suction power is further considerably increased by the fact that a large part of the suction flow passing through is made up of unpolluted air from the region above the tapping spout, unless the latter is covered in the exhaust region (which in turn would entail other disadvantages). A further disadvantage of lateral exhausting consists of the deposits which, in the course of time, build up or may build up on the hard to reach bottom of the horizontal exhaust ducts.

SUMMARY OF THE INVENTION

The present invention overcomes or alleviates the disadvantages and shortcomings of the prior art by utilizing an evacuation installation wherein the emanations can be exhausted appreciably more efficiently and with less consumption of power primarily because the suction openings, ducts and the like of the exhaust installation are brought closer to the places or origin of the emanations; and because the gaps between the different components of the exhaust installation for the supply of false or additional air necessary for the exhausting are kept no larger than necessary. The exhaust installation of the present invention can be used for shaft furnaces of practically any size, including small and medium sized furnaces.

In accordance with the present invention, the installation for evacuating emanations in the taphole region of a shaft furnace (e.g blast furnace) of the type having a blast connection arrangement around the furnace bosh, together with a blast connection stage or platform for the inspection and servicing of the blast connections, and in which the molten pig iron is periodically tapped with the aid of tapping means and run off through a main tapping spout includes the feature wherein a portion of the blast connection platform is adapted to be tilted away in the upward direction. This tiltable platform portion, when in its untilted position forms, together with vertical side walls which extend vertically downward from the two side ends of the platform portion to a point near the ground, a flue-like exhaust duct for the emanations produced directly in the taphole region. The present invention further comprises a movable exhaust hood connected to a stationary suction line and a mobile tapping spout hood having at the top an exhaust opening situated under the exhaust hood. The flue-like exhaust duct leads into the open end of the tapping spout hood (e.g., its end near the furnace) and both the emanations produced under the tapping spout hood and those passing out of the exhaust duct are drawn off through the top exhaust opening, the exhaust hood and the suction line connected thereto. Finally, the present invention also includes a transfer device for moving the mobile tapping spout hood preferably laterally parallel to itself and thus removing it from the tapping spout region in order to free space for the movement of the tapping appliances (e.g. taphole drilling machine and taphole gun).

In accordance with the present invention, that portion of the blast connection platform which is adapted to be tipped away in the upward direction as well as the two aforementioned vertical side walls are cooled by the circulation of water. As a result, not only are these parts themselves effectively protected against heavy thermal stressing, but in addition, improved stay conditions are created in the immediate proximity.

The tipping of the tiltable platform portion is preferably effected with the aid of at least one electric lifting spindle or the like.

The above mentioned transfer device, which serves to move the movable tapping spout hood is provided with a special suspension and lifting mechanism for this hood. This mechanism reduces to a minimum independent movements of the hood, such as swinging and oscillation, during its displacement. Collisions between the hood and adjacent components of the installation which could otherwise occur, are thus avoided and both the hood itself and these components are protected against damage. In addition, this relatively stiff suspension of the tapping spout hood makes it possible for the latter to be positioned more accurately during the various displacement operations, so that, as indicated above, the gaps between the hood and the adjoining parts of the exhaust installation can be kept small. By using the transfer device of the present invention, the risk of accidents in the manual movement of the hood is eliminated. This is particularly important in the region of the taphole and tapping spout.

Finally, the present invention provides an additional moveable platform, with the aid of which the tiltable platform portion can be temporarily extended to the rear, that is, in the direction away from the furnace (for example, between two tappings). More advantageous space conditions for inspection and servicing work on the blast connection or connections located in this region are thereby created.

The above discussed and other features and advantages of the present invention will be appreciated and understood by those skilled in the art from the following detailed description and drawings.

DESCRIPTION OF THE PREFERRED EMBODIMENT

Figure 1:
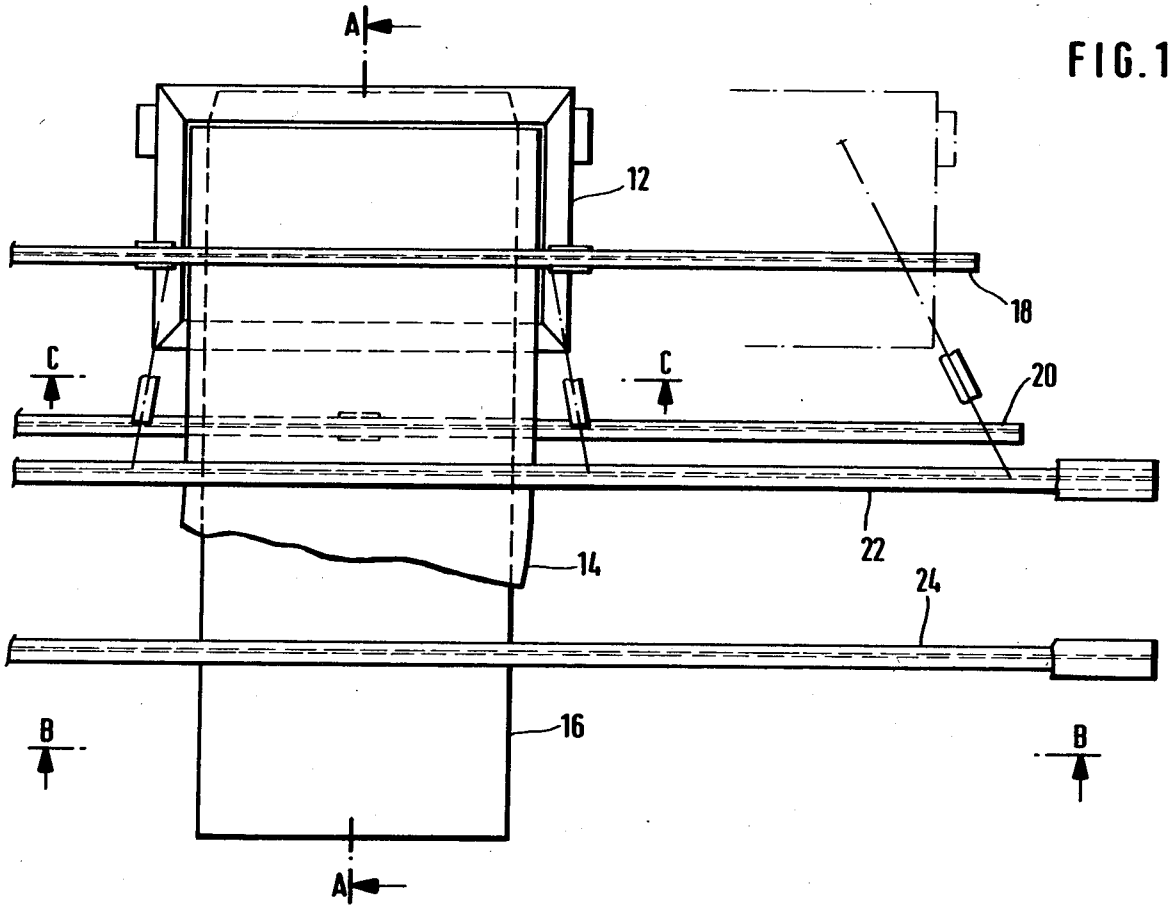
FIG. 1 is a top plan view, primarily of the movable exhaust hood, a part of the stationary exhaust line, a part of the mobile tapping spout hood, and the two pairs of rails on which the movable exhaust hood and the mobile tapping spout hood respectively travel.

FIG. 1 is a top plan view of a movable exhaust hood 12, a part of a stationary exhaust line 14, a part of a mobile tapping spout hood 16, and two pairs of rails 18, 20 and 22, 24 for the travel of the movable exhaust hood 12 and of the mobile tapping spout hood 16, respectively. FIG. 1 serves with the assistance of the sections or viewing directions A—A, B—B and C—C, to clearly explain the views shown in FIGS. 2, 3 and 4, respectively. The position of the parts shown in FIG. 1 in relation to the blast furnace (which is not shown in FIG. 1), can for example, be clearly seen in FIG. 2.

Figure 2:
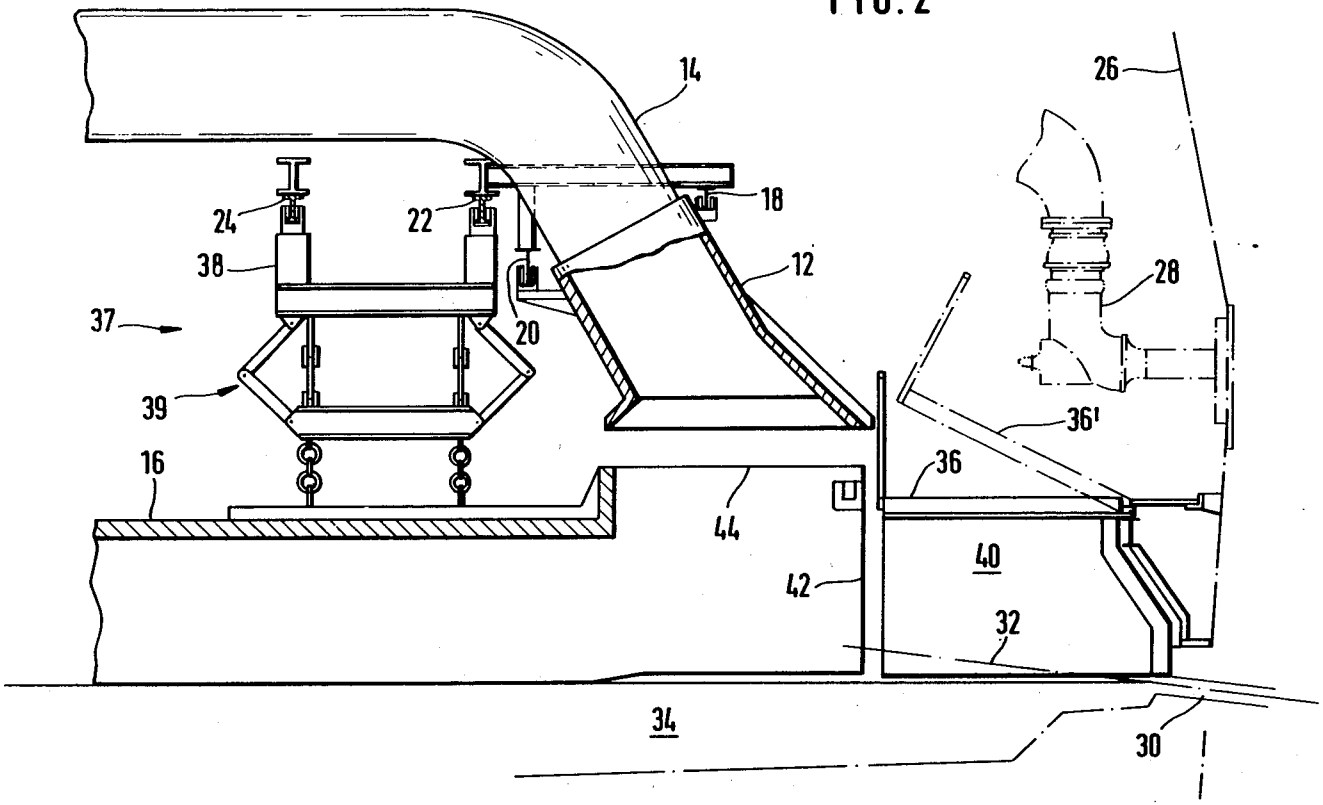
FIG. 2 is a side elevation view, partly in cross section along the line A—A of FIG. 1.

In FIG. 2 a part of the blast furnace wall 26, a blast connection 28, a main taphole 30 with its axis 32, and a main tapping spout 34 are shown. A working stage or platform extends under the blast connections and around the furnace for the inspection and servicing of the blast connections. A portion 36 of this platform situated above the main taphole 30 and main tapping spout 34 can be tilted away in the upward direction (position 36'). It is necessary for the tiltable platform portion 36 to be tilted away or swung up in this manner in order to make room for access to the taphole when required, and possibly for placing in position the drilling machine and taphole gun (both not shown).

Also shown in FIG. 2 are the movable exhaust hood 12, which is adapted to travel sideways (e.g. laterally), that is, at right angles to the plane of the drawing, on rollers along the rails 18, 20 as well as stationary suction line 14 and mobile tapping spout hood 16, which can be raised and moved laterally by means of a transfer device 37 in order to make room for the positioning of the tapping appliances. This schematically represented transfer device (see also FIG. 8) comprises a trolley 38 adapted to run along rails 22, 24, a suspension and lifting mechanism 39, and a girder framework (not shown—see FIG. 9), on which the rails 22, 24 are suspended. Tiltable platform portion 36, when swung down, forms together with the adjoining side walls (see FIG. 7) a flue-like exhaust duct 40 for the emanations occurring in the taphole region, particularly during tapping, that is, when the molten metal (pig iron) is flowing out. Exhaust duct 40 leads into the open end 42 of tapping spout hood 16 (e.g. its end near the furnace); hood 16 being provided under the exhaust hood 12 with a top exhaust opening 44. Both the emanations produced under the tapping spout hood 16 in the tapping spout 34 and those given up by the exhaust duct 40 are drawn off through the exhaust hood 12 and the suction line 14 by way of this exhaust opening 44.

Figure 3:
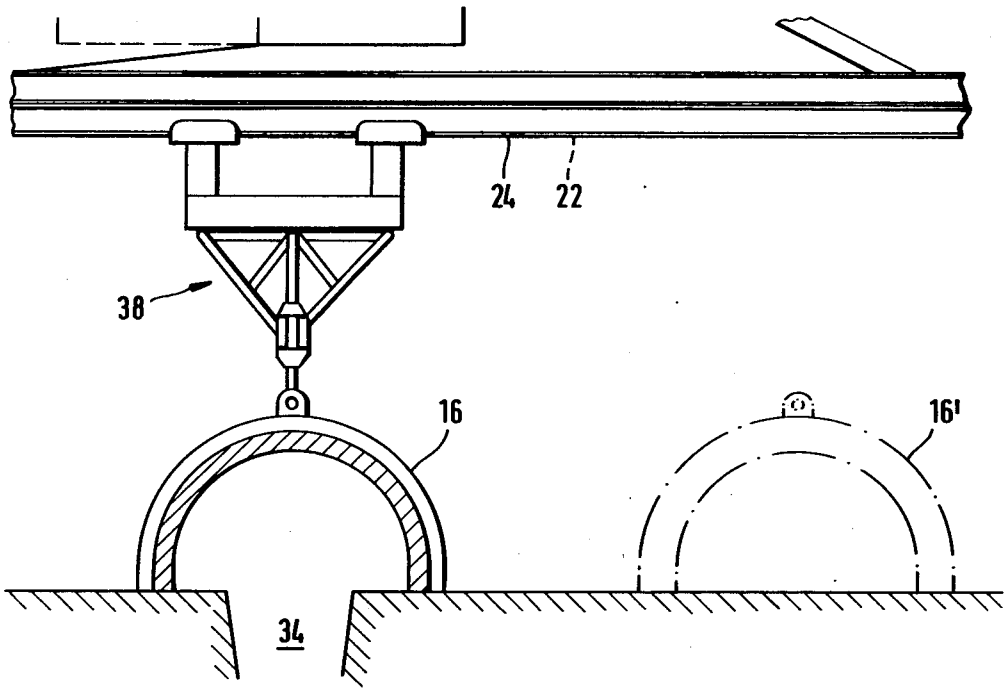
FIG. 3 is an elevation view along the line B—B of FIG. 1.

FIG. 3 is an elevation view corresponding to the section B—B in FIG. 1 and shows tapping spout hood 16 in its working position above spout 34 and also, in dot-dash lines, in its parked position 16'. Spout 34 is brought to the parked position when lifted by means of the suspension and lifting mechanism 39, by laterally travelling along rails 22, 24 followed by lowering.

Figure 4:
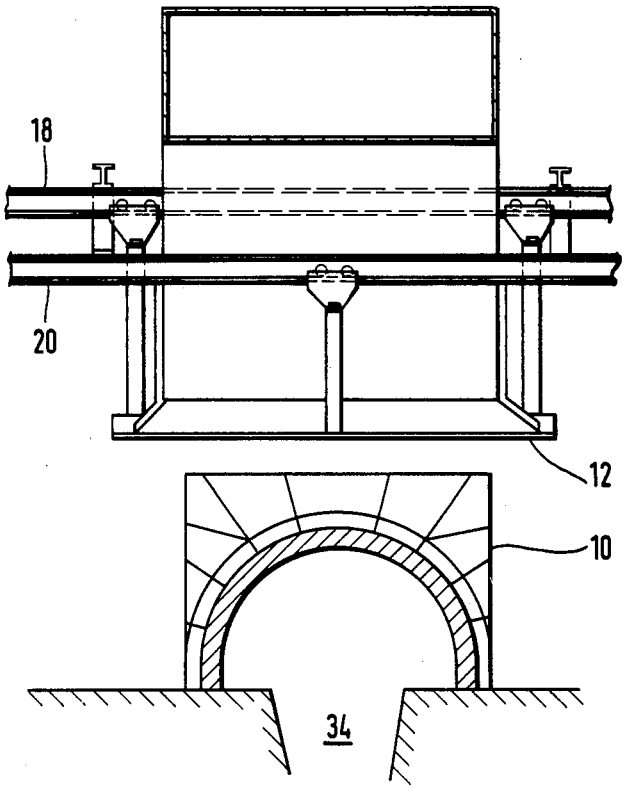
FIG. 4 is an elevation view along the line C—C of FIG. 1.

FIG. 4 is an elevation view corresponding to the section C—C in FIG. 1, with tapping spout hood 16 in its working position above spout 34; and shows exhaust duct 12 adapted for travelling sideways along rails 18, 20. The exhaust duct is moved in this way with the aid of means (not shown) which are known per se, for example, an integrated electric motor.

Figure 5:
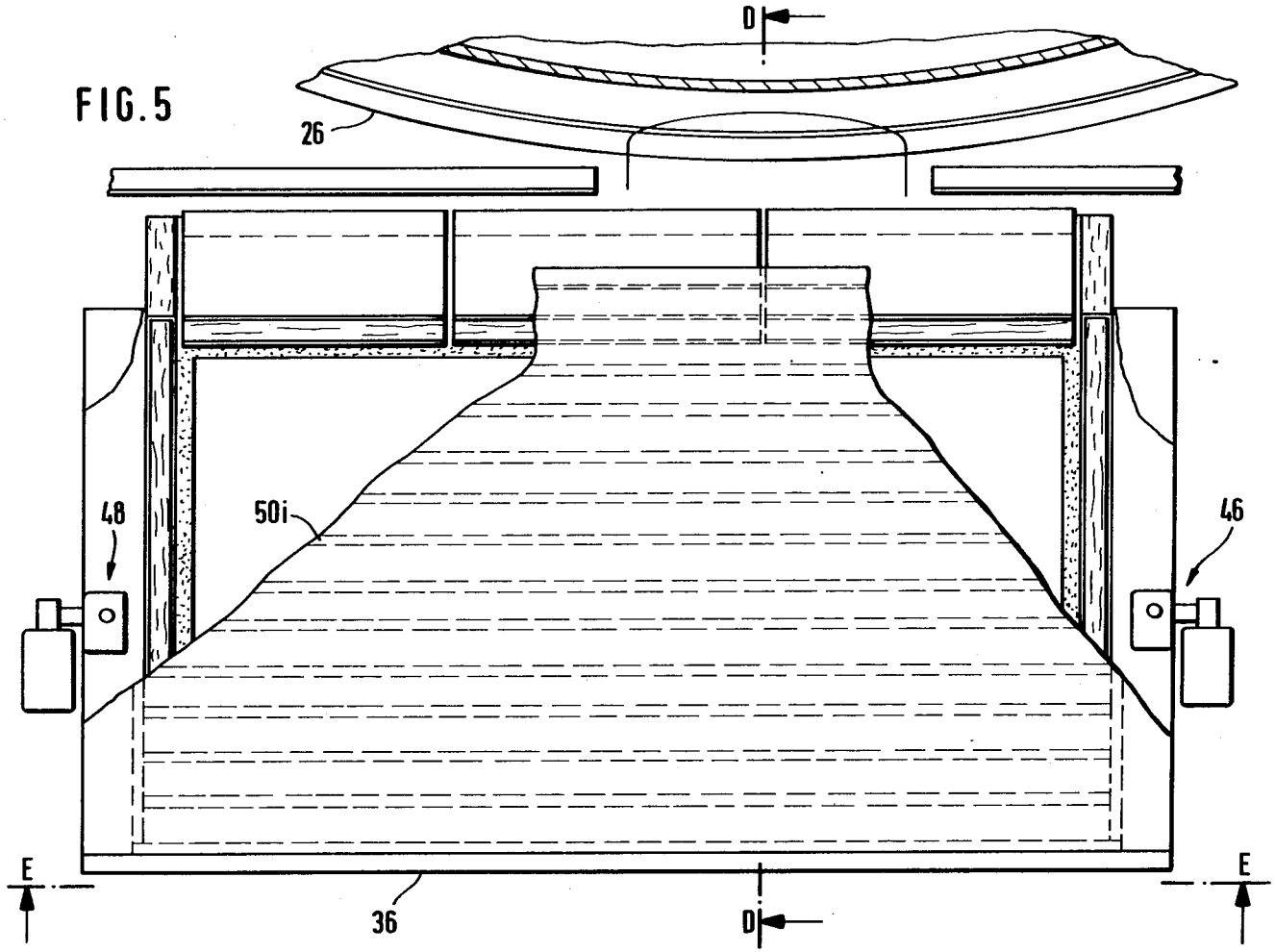
FIG. 5 is a top plan view of the tiltable platform portion and two electric lifting spindles in accordance with the present invention.

FIG. 5 is a top plan view of tiltable platform portion 36 in front of blast furnace 26. This portion of the platform can be swung up (see also FIG. 6), for example, by means of two electric lifting spindles 46, 48 (or the like) disposed on each side of platform portion 36. A corresponding section through the platform 36 shows a plurality of cooling water pipes $50_i$ extending inside platform 36.

Figure 6:
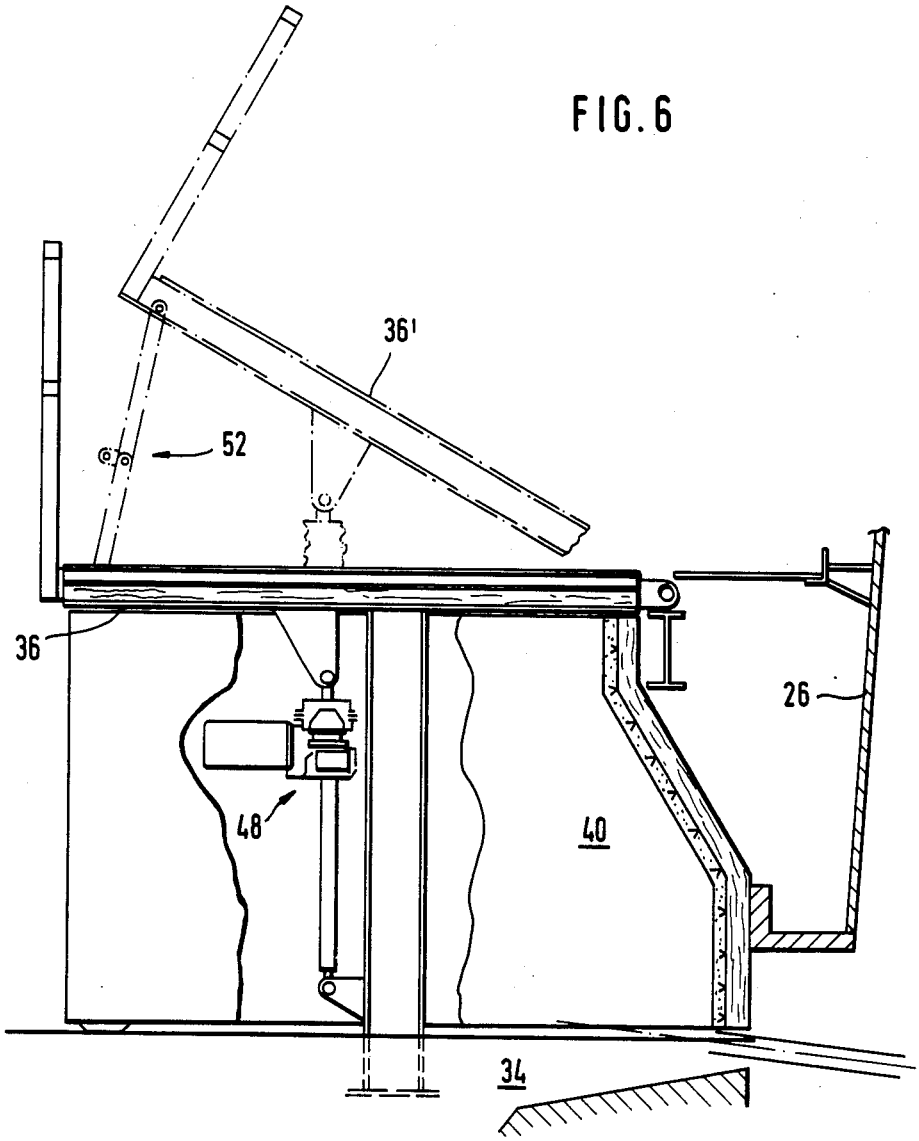
FIG. 6 is a cross sectional elevation view along the line D—D of FIG. 5.

FIG. 6 is an elevation view corresponding to the section D—D in FIG. 5. FIG. 6 shows platform portion 36 in the working position and, in dot-dash lines, in the upwardly tilted or swung position 36'. With the aid of a linkage 52 provided with a lockable joint, tiltable portion 36 can be locked in the upwardly tilted position 36'.

Figure 7:
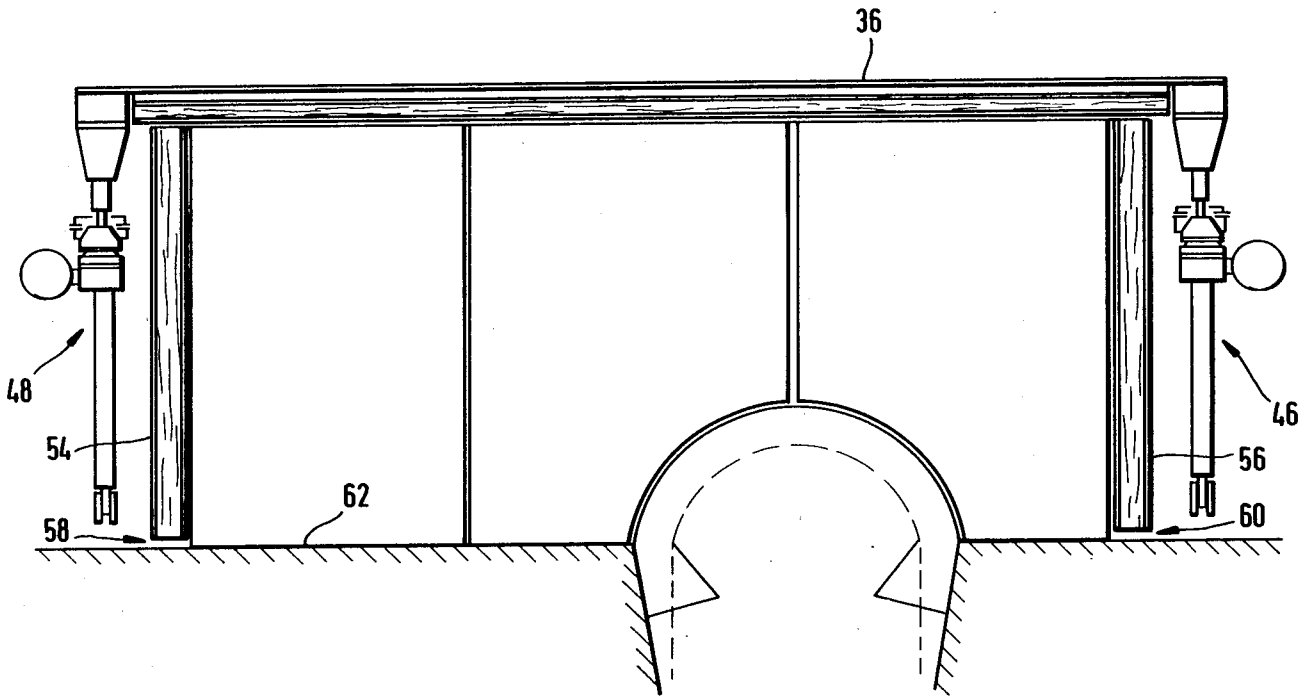
FIG. 7 is an elevation view along the line E—E of FIG. 5.

FIG. 7 is an elevation view corresponding to the section or viewing direction E—E in FIG. 5. FIG. 7 shows in Particular the vertical side walls 54, 56 which extend from the two side end of platform portion 36 downwardly to a point close to the ground. The two side walls 54, 56 are preferably also (like the platform portion 36) provided with a cooling circuit (not shown).

Figure 8A:
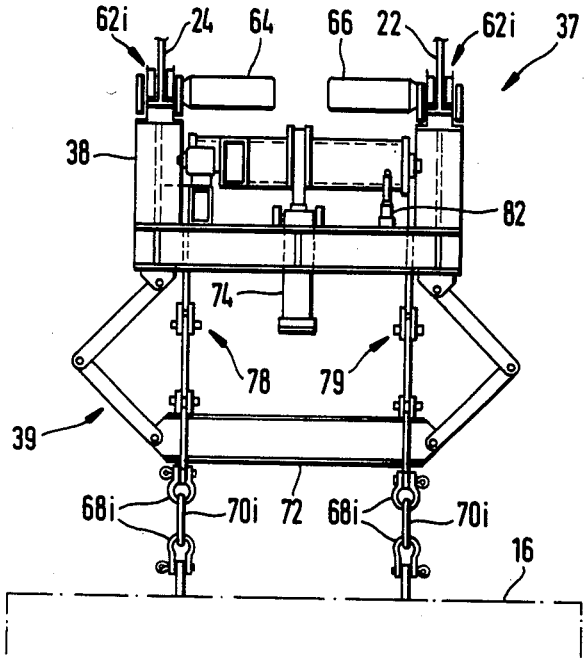
FIG. 8A is a front elevation view of a transfer device including parts of the suspension and lifting device for the tapping spout hood in accordance with the present invention.
Figure 8B:
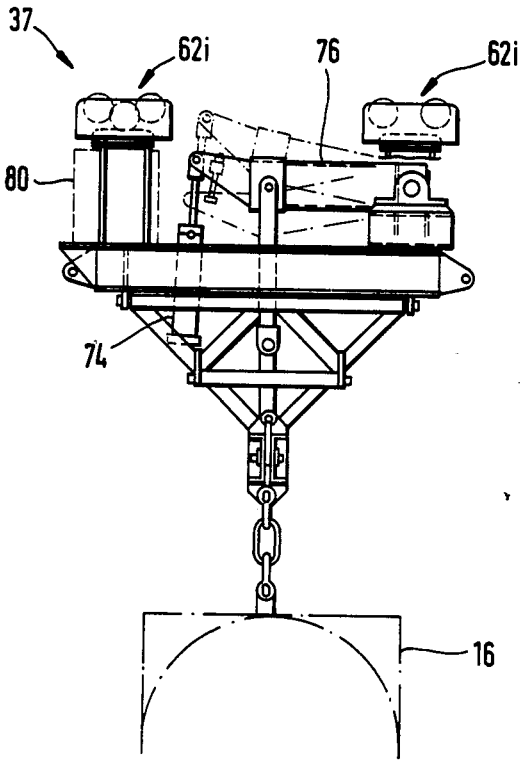
FIG. 8B is a side elevation view of the arrangement shown in FIG. 8A.
Figure 9:
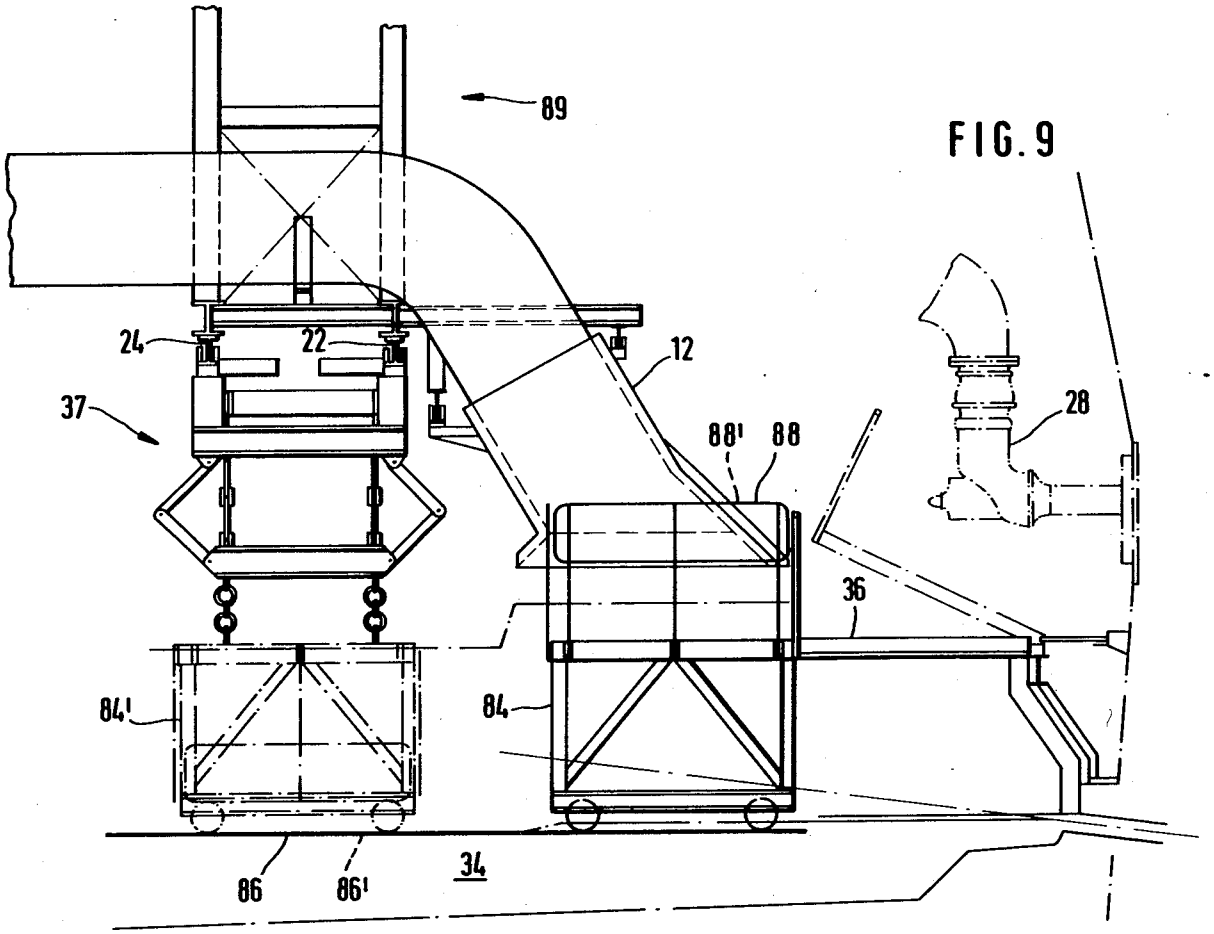
FIG. 9 is an elevation view showing various positions of an additional mobile platform in accordance with the present invention.

FIGS. 8A and 8B show constructional details of transfer device 37 (but without the girder framework on which rails 22, 24 are suspended; in this connection see FIG. 9), FIG. 8A being a front view and FIG. 8B a side view of device 37. The top part of device 37 is in the form of a trolley 38 adapted to travel along rails 22, 24 with the aid of rollers $62_i$. The drive consists of electric motors 64, 66 driving one roller $62_i$ per rail. Tapping spout hood 16 is suspended at two points lying outside its center of gravity, by means of shackles $68_i$ and chain links $70_i$, on a lifting carrier 72 extending transversely of rails 22, 24. Carrier 72 is suspended on trolley 38 by means of the suspension and lifting mechanism 39. Mechanism 39 is designed in a known manner so that during the lifting movement of carrier 72, the latter cannot make horizontal moments relative to trolley 62 (at least in the longitudinal direction of rails 22, 24), but only a vertical movement. It is thus ensured that during the lifting and travelling operation of tapping spout hood 16, the hood 16 will not be able to make undesirable oscillating and/or swiveling movements. As a result, collisions between the hood and other components of the installation will not be possible. In addition, this restriction of the movement of the hood has the effect that displacements of the center of gravity of the hood through wear, deposits, and the like during the displacement movements of the hood are of no importance. In particular, however, this relatively stiff suspension enables the hood to be accurately positioned during its displacements, so that the air gaps between the hood and the adjoining components of the exhaust system can be kept small and the exhaust action is correspondingly intensified. Hood 16 (or the carrier 72 with respect of the vertical direction) is allowed a slight freedom of movement through its suspension by means of shackles $68_i$ and chain links $70_i$. Hood 16 can thus make a close fit with the ground without any deformation occurring in the connection means between carrier 72 and hood 16.

The raising and lowering movements of lifting carrier 72 are produced by a hydraulic cylinder 74, which acts via a yoke 76 on the lifting linkage 78, 79. The action of hydraulic cylinder 74 on a yoke and lifting linkage arrangement of this kind enables a smaller cylinder and/or lower oil pressures to be used.

The pressure oil is taken from a pressure oil tank having an integrated electric motor and pump, this electrohydraulic arrangement being mounted as a unit 80 on trolley 38. The direction of flow of the pressure oil is controlled by electromagnetic directional valves in electrohydraulic unit 80. An emergency hand pump 82 is provided to enable tapping spout hood 16 to be removed even in the event of a fault in the electrohydraulic pump.

During normal operation of the hood, the movement of transfer device 37 is controlled from a common control panel for this device and the tapping appliances (drilling machine and taphole gun). In this way a collision between the tapping appliances and the tapping spout hood can be prevented by electrical interlocking. The displacement of the tapping spout hood is entirely automatic in both transfer directions. After the operator has pressed the "hood away" button to activate the system, the hydraulic pump motor is started and the electromagnetic directional valve is opened to apply pressure oil to one side of the cylinder piston, whereby hood 16 is lifted off the ground. A limit switch is thereby operated, so that the trolley motors are started in order to remove the hood from the tapping spout region. During the travel of the transfer device a limit switch is operated at a determined point at which the hood has made room from the tapping appliances, and this switch initiates the working phase of these appliances. When the hood transfer device has reached the end of the transfer path, a third limit switch indicates its arrival at the "parking position". The electromagnetic directional valve is then operated to lower the hood to the ground.

For the return of the hood to the working position above the tapping spout the procedure is reversed. The hood is positioned above the spout by limit switches. An emergency stop switch is provided to terminate the transfer movement. A "convey" mode is also provided, in which the automatic system is put out of action so that the transfer device may be used as a crane for conveying loads under the hood transfer girder framework 89, as the latter makes it impossible for the bay crane to have access to the tapping spout region.

FIG. 9 shows an additional service platform 84, which is used to enlarge the servicing area available in front of the blast connection 28. As shown in FIG. 9 the tapping spout hood must be removed in order to bring this additional service platform (abbreviated as "additional platform") into position. Moreover, in order to obtain the necessary overhead clearance above the additional platform when it is in its working position, the extraction hood 12 must be moved away to the side.

In order to bring the additional platform into its working position in front of the tiltable platform section 36, it is first brought by the tapping bay crane from its parked position (not shown) to the end of the path of movement of the transfer device. By means of the same shackles as are used to suspend the tapping spout hood on the transfer device, the additional platform is then fastened to the latter. The additional platform 84 is then raised by the transfer device, moved along, lowered above the main tapping spout 34 onto rails 86, 86' let into the ground on both sides of said spout to assume an intermediate position, and released from the transfer device 37. By means of a mobile drive unit (a chain hauling device or the like (not shown)), the additional platform is then moved into its working position against platform portion 36. In order to ensure a safe working surface, additional platform 84 is joined by suitable connection means to platform portion 36. Removable handrails can then also be used.

It will be appreciated that the additional platform is returned to its parked position (not shown) by the reverse procedure.

Through the provision of a mobile, removable additional platform, the tiltable platform portion 37 above the taphole can be kept small and sufficiently light to be easily lifted and lowered in order to provide access to the taphole if this should be required; and to provide room for movement for the tapping appliances and the tapping spout hood. It will be appreciated that because the additional platform is removable, the exhaust hood 12 can be disposed, above the taphole, closer to the sources of emanations, so that the exhaust action is appreciably greater. The previously mentioned girder framework for the rails 22, 24 is indicated at 89.

Figure 10A:
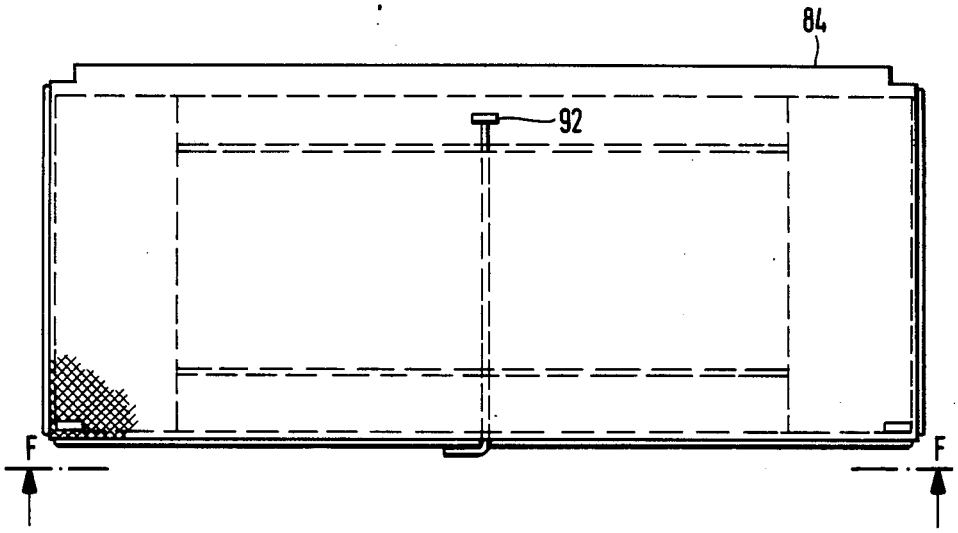
FIG. 10A is a top plan view of the additional platform.
Figure 10B:
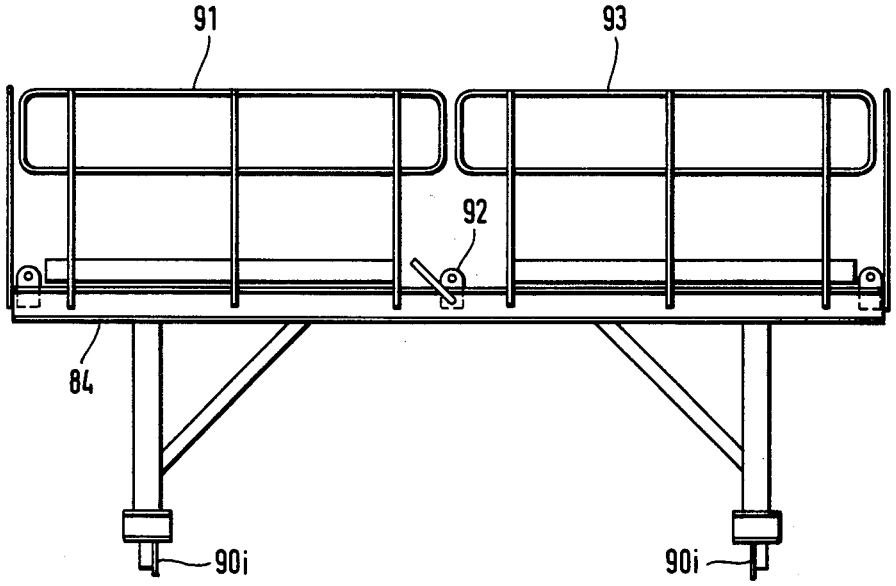
FIG. 10B is a front elevation view of the additional platform along tee line F—F of FIG. 10A.

FIGS. 10A and 10B show details of the additional platform 84, FIG. 10A being a top plan view and FIG. 10B a front view in the viewing direction F—F (FIG. 10A) of the platform. The platform rests on rail wheels $90_i$ on rails (not shown) set into the floor of the tapping bay, so that it can be brought against the permanent platform portion 36 (FIG. 9). A central fastening hook 92 gives rise to the risk of stumbling and can therefore be pulled out. Removable handrails 91, 93 are also provided on the platform.

With regard to the special arrangement of the suction line 14 and exhaust hood 12, it will be further understood that because of the advantageous position of hood 12, the greater part of the tapping spout emanations is collected, even when tapping spout hood 16 is not in its working position above the tapping spout. Since the exhaust hood 12 is disposed above the sources of the emanations, the natural thermal upthrust of the hot emanations can be utilized and the effectiveness of the exhaust operation can be improved beyond what can be achieved with laterally disposed exhaust scoops of the type used in the prior art.

The movable exhaust hood 12 is disposed at a height which leaves adequate head clearance for operators on the tapping bay floor. If this height has to be increased (for example, in order to be able to use mobile equipment in the tapping spout region; or in order to provide additional space behind the platform portion 36), the exhaust hood 12 is moved to the left or right along its rails 18, 20.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. An installation for evacuating emanations in the taphole region of shaft furnaces having a blast connection arrangement around a furnace bosh, together with a blast connection platform for the inspection and servicing of the blast connections, and in which molten metal is periodically tapped with the aid of tapping means and run off through a main tapping spout, further comprising:

a portion of the blast connection platform being tiltable in an upward direction, said tiltable platform portion including opposed vertical side walls which extend vertically downward from two side ends of said platform portion to near the floor, wherein when said tiltable platform portion is in its untilted position, said platform portion together with said vertical side walls form exhaust duct means for the emanations produced in the taphole region;

said installation further comprising;

movable exhaust hood means connected to a stationary suction line; and mobile tapping spout hood means including an upper surface having a top exhaust opening positioned under said exhaust hood means, said mobile tapping spout hood means further including a lateral end opening, said exhaust duct means communicating with said lateral end opening of said tapping spout hood means, wherein both the emanations produced under the tapping spout hood means and those passing out of said exhaust duct means are drawn off through said top exhaust opening and into said exhaust hood means and said stationary suction line.

2. An installation as claimed in claim 1 wherein:

at least one of said tiltable platform portion and at last one of said two vertical side walls are cooled by internal coolant pipes.

3. An installation as claimed in claim 1 including:

at least one electric lifting spindle means for tilting away said tiltable platform portion.

4. An installation as claimed in claim 1 including:

rollers on said exhaust hood means for moving said exhaust hood means laterally parallel to itself by means of said rollers on rails.

5. An installation as claimed in claim 4 including:

servo drive means for moving said exhaust hood means.

6. An installation as claimed in claim 1 including:

transfer means for moving said mobile tapping spout hood means.

7. An installation as claimed in claim 6 wherein:

said transfer means includes means to move said mobile tapping spout hood means laterally parallel to itself.

8. An installation as claimed in claim 6 wherein said transfer means comprises:

girder framework means;

rails suspended on said framework means;

trolley means adapted to travel along said rails;

suspension and lifting means suspended on said trolley means and attached to a lifting beam; and suspension means between said lifting beam and said mobile tapping spout hood means.

9. An installation as claimed in claim 8 wherein said suspension and lifting means comprises:

an articulated rod system wherein said lifting beam cannot make any horizontal movements relative to said trolley means at least in the direction of said rails.

10. An installation as claimed in claim 8 including:

a hydraulic cylinder on said trolley means for providing the lifting movement to lift said lifting beam.

11. An installation as claimed in claim 10 including:

an autonomous reservoir mounted on said trolley means for supplying said hydraulic cylinder with pressure oil.

12. An installation as claimed in claim 10 including:

hand pump means on said trolley means.

13. An installation as claimed in claim 10 including:

yoke means; and lifting linkage means inserted between said hydraulic cylinder and said lifting beam.

14. An installation as claimed in claim 8 including:

motor means mounted on said trolley means for moving said trolley means along said rails.

15. An installation as claimed in claim 8 wherein said suspension means between said lifting beam and said mobile tapping spout hood means comprises:

shackles and chain links.

16. An installation as claimed in claim 1 including:

mobile platform means for extending said tiltable platform portion towards the rear.

17. An installation as claimed in claim 16 including floor rails on the tapping bay floor on both sides of the tapping spout means and including rail wheels on said mobile platform means and including:

means for moving said mobile platform means via said rail wheels on said bay floor in the direction of said tiltable platform portion means.

18. An installation as claimed in claim 17 including a tapping bay crane and wherein said mobile platform means travels between a parked position and a working position and including:

means for bringing said mobile platform means out of its parked position into its working position behind said tiltable platform portion by being positioned with said tapping bay crane and said transfer means onto said bay floor rails and then moved on said bay floor rails, with the aid of drive means in the direction of said tiltable platform portion so as to be brought against said tiltable platform portion.

19. An installation as claimed in claim 6 wherein said transfer means removes said tapping spout hood means from the tapping spout region in order to free space for the movement of tapping appliances and including:

means for automatically electrically interlocking the movement cycles of said transfer means and tapping appliances.

* * * * *